United States Patent [19]

Legrand et al.

[11] 4,330,243

[45] May 18, 1982

[54] APPARATUS FOR MOULDING CONCRETE ELEMENTS

[75] Inventors: Pierre Legrand, Chatenay-Malabry; Pierre Guinard, Maintenon, both of France

[73] Assignee: Freyssinet International (STUP), Boulogne-Billancourt, France

[21] Appl. No.: 157,214

[22] Filed: Jun. 6, 1980

[30] Foreign Application Priority Data

Jun. 13, 1979 [FR] France ..... 79 15131

[51] Int. Cl.[3] ..... B28B 9/04

[52] U.S. Cl. ..... 425/111; 264/228; 264/334; 425/440; 425/444

[58] Field of Search ..... 264/228, 334, 336; 425/111, 440, 444

[56] References Cited

U.S. PATENT DOCUMENTS 3,611,518 10/1971 Glass ..... 425/111 X

*Primary Examiner*—Thomas P. Pavelko

*Attorney, Agent, or Firm*—David M. Ostfeld

[57] ABSTRACT

A device for removing from their moulds elements made of pre-stressed concrete employing stretched adherent reinforcements on a "long bed" and passing through at least one row of moulds of said elements, wherein, prior to the release of the tension of the reinforcements, each of the elements is detached from its mould by an upward thrust exerted on at least one movable portion of the bottom of this mould, then maintained in lifted position until the tension is released and these reinforcements are cut.

8 Claims, 3 Drawing Figures

I
I
C
B
B
D
D
D
C
A
1
2
2a
3
4
5
6
7
8
9
10
11
12
13
14
15
17
18
19
20
22
24
30
d

APPARATUS FOR MOULDING CONCRETE ELEMENTS

The present invention relates to an apparatus for moulding prestressed concrete elements and particularly to a device for removing from their moulds prestressed concrete elements moulded on a long bed, whilst the reinforcements which they comprise remain under tension.

Mass-production of elongated elements of prestressed concrete employing stretched reinforcements adhering to this concrete is currently obtained by means of a "long bed". A bed of this type comprises, at one of the ends of a long flat area (for example one hundred meters long), elements for fixing a plurality of sets of parallel reinforcements and, at the other end, means for placing all these reinforcements under tension, simultaneously or not, whilst the moulds, disposed in parallel rows along the bed, have said reinforcements passing therethrough. After setting and curing of the concrete which has been cast in these moulds, the tension of the reinforcements is released, the reinforcements are cut between consecutive moulds and the elements are then removed from the moulds.

This modus operandi has a drawback when the moulded elements must be locally provided with hollows or portions in relief, which are normally obtained, respectively, by means of bosses or depressions of considerable draft made in the wall and bottom of the mould. In fact, when the tension of the reinforcements is released, the elements still being in their respective moulds, each of them shortens by the transfer of the tension from the reinforcements to the concrete and, as the mould does not change dimensions, these hollows and portions in relief are subjected to a shearing effect, of low amplitude but very powerful, which alters them, particularly by causing chipping or splintering.

It is an object of the present invention to remedy these drawbacks.

According to the invention, prior to the release of the tension of the reinforcements, each of the elements is detached from its mould by an upward thrust exerted on at least one mobile portion of the bottom of this mould, then maintained in lifted position until the tension is released and the reinforcements are cut.

The thrust may be furnished by any means (hydraulic, mechanical, pneumatic). For all the rows of moulds, the necessary thrusts may be exerted simultaneously or spread out in time.

In an advantageous embodiment of the invention, the necessary thrusts are provided by sets of mobile inclined ramps, coupled in rows and movable along the elongated area by a tractor mechanism. This latter is advantageously formed by one or more jacks.

The transmission of the action of each ramp to a mobile mould portion is preferably obtained via a guided push member, directly or indirectly manoeuvred by a sliding shoe or a roller cooperating with said ramp.

However, when making such elements, it is known to be advantageous, in order to obtain a good compaction of the cast concrete, to subject the moulds to a vibration and preferably, in order to obtain a more rapid removal from the moulds, to a heating by steam.

Consequently, in an advantageous embodiment of the invention, a mechanical separation must be assured between the mould comprising the mould portions lifted by the upward thrust and the means furnishing this thrust.

When this thrust is furnished by mobile ramps, a space may be arranged between two mechanical transmission members interposed between the ramp and the mobile mould portion.

To this end, in a preferred embodiment of the invention, the moulds, capable of sliding on elastic supports so as to allow, on the one hand, their longitudinal positioning on the bed and, on the other hand, their vibrations after filling, are associated each with relative freedom of vertical displacement, with equipment capable of rolling on the mobile ramps, coupled in rows by means of traction, said equipment comprising surfaces capable of acting, after an adjustable idle stroke, on the push members ensuring the displacement of the mobile mould portions.

The invention will be more readily understood on reading the following description with reference to the accompanying drawings, in which.

Figure 1:
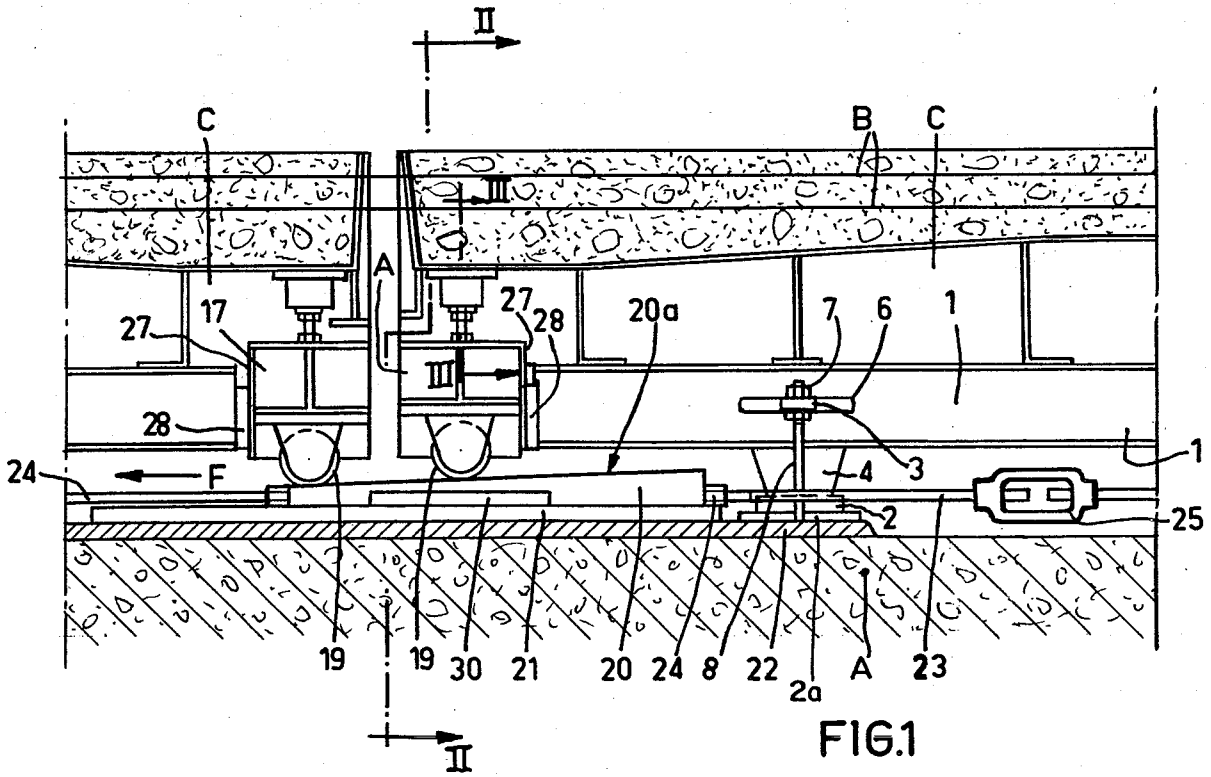
FIG. 1 is a partial side elevation of two successive moulds placed on a long bed; this elevation corresponds to the line of section I—I of FIG. 2.
Figures 2, 3:
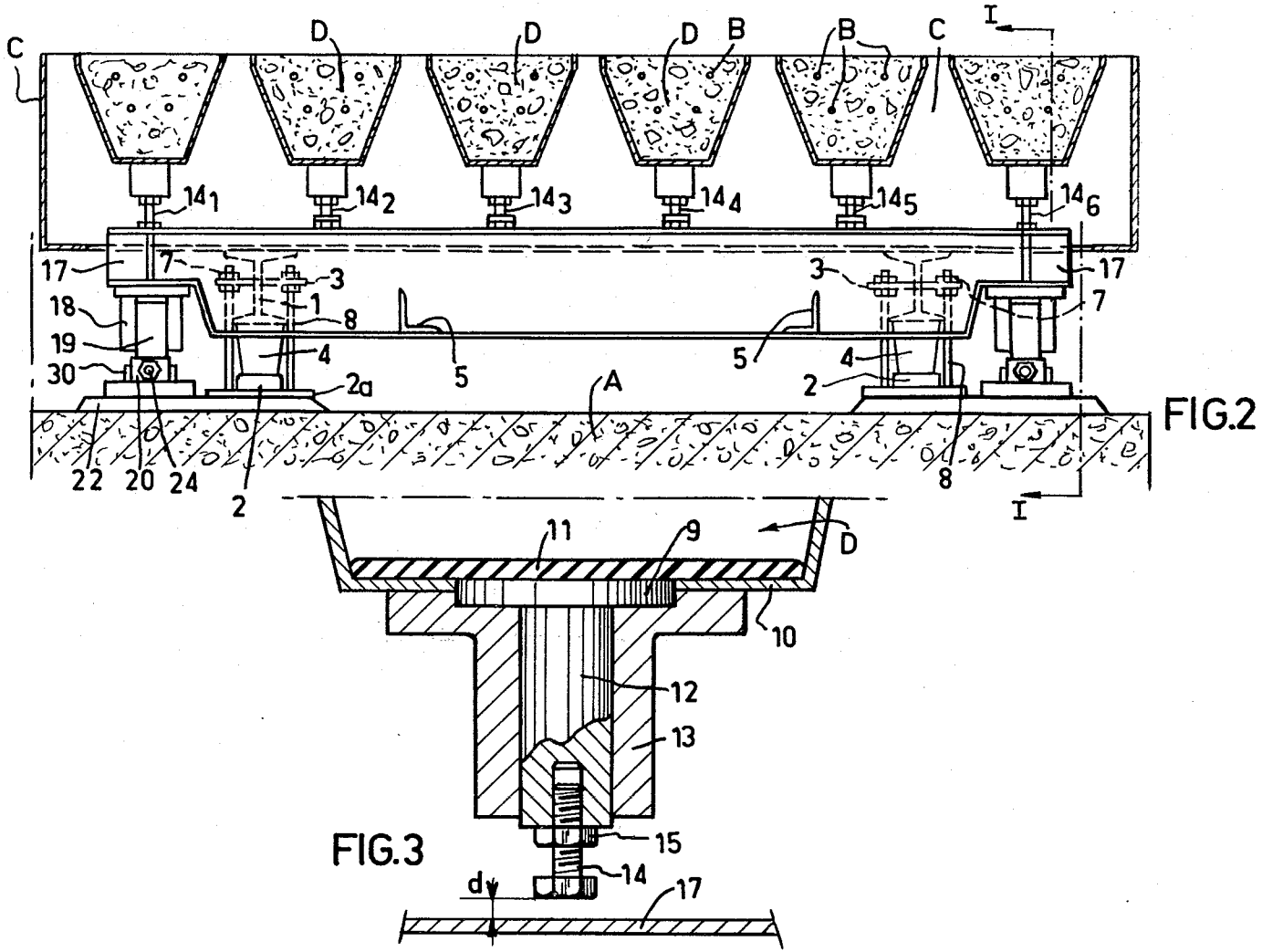
FIG. 2 is a view along II—II of FIG. 1 of one of these moulds.
FIG. 3 is an enlarged section along III—III of FIG. 1.

Referring now to the drawings, the base A of the long bed is an elongated foundation of concrete parallel to which are stretched the sets of reinforcements B made of hard steel between a tensioning arrangement (not shown) associated with a long stroke jack device and a tension-release arrangement (likewise not shown) which, in the course of a final operation, enables the tension of the reinforcements to be released. Each mould C, adapted in the present case for simultaneously making six prestressed concrete elements D (in this case railway sleepers), is carried by two longitudinal elements 1 (FIGS. 1 and 2) which rest on base A via four shoes 4 sliding owing to pads 2 made of elastomer on metal sheets 2*a*.

A limited longitudinal displacement of the concrete elements and of the moulds, by reason of the shortening caused by the final release of the tension of the reinforcements, is allowed by the shoes 4 sliding on the surfaces 2*a*. The lift of the moulds is prevented by bars 3 which pass through the longitudinal elements 1 of the mould in longitudinal slots 6 and are fixed at each of their ends, between two nuts 7, to two vertical uprights 8 sealed in the base A.

Each compartment D of mould C, through which four of the reinforcements B pass, comprises towards its ends (cf. FIG. 3), a mobile portion 9 in its bottom 10, said mobile portion being covered by a supple membrane 11 made of elastomer or whose join with the fixed portion is covered by a disposable section of adhesive tape to avoid any intrusion of laitance in the mechanism for lifting this mobile portion. The mobile portion is fast with a push member or piston 12 movable in the guide 13 fixed to the mould compartment, which guide is extended by an adjusting pin 14 with lock nut 15.

At each of the ends of the mould C, the lower ends of the pins 14 ($14_1$ to $14_6$ in FIG. 2) are placed opposite the upper face of a cross-piece 17, provided at its ends with yokes 18 carrying rollers 19.

In the present case, the rollers 19, located in the same plane and associated with two consecutive moulds C, roll on the same ramp $20_a$ of an inclined plate 20 which may slide, between two guides 30, on the upper surface of another flat metal plate 21 sealed on the base A via a raised concrete layer 22.

The plates 20 of the same alignment are coupled together by connecting rods 23 comprising lock nuts 24 and devices 25 for adjusting length.

The two cross-pieces 17, associated with the same mould C, are connected together by longitudinal elements 5, so as to form a frame enclosing the base of the mould. Between the ends of the longitudinal elements 1 and the plates 27 fixed between the flanges of the cross-pieces 17, there are interposed thick elastomer plates 28 which render said frame fast with the mould in its longitudinal displacements, but allow, in cooperation with the elastic studs 2 and the slots 6, the vibration of this mould without excessive transmission of vibratory energy towards the base A.

In addition, a space d (FIG. 3) is provided to this end between the heads of pins 14 and the corresponding crosspiece 17.

Thus, when, after casting, vibration and steam curing of the concrete in the mould compartments, each of the moulded elements is to be extracted from its mould, without relaxing the reinforcements, a traction is exerted in the direction of arrow F on all the rows of plates 20 coupled by rods 23. By the ramps 20 the rollers 19 and consequently the cross-pieces 17 are lifted, with respect to the mould whilst the moulds are prevented from being lifted by the bars 3. The crosspieces 17 thus come into contact with the pins 14 furnishing the upward thrust which lifts the mobile portions 9 of the moulds. The concrete elements are then detached from their moulds and slightly raised from their bottom. With respect to the length of the sets of reinforcements, the slight upward displacement which results therefor hardly changes the tension of these reinforcements. It would, moreover, be possible to lift the arrangements connecting these reinforcements, simultaneously.

It is therefore then possible, without risks of chipping or splintering (particularly for the rail base housings), to relax the reinforcements then to cut them, level with the end faces of each of the moulds, to release each of the moulded elements.

The release of tension is preferably effected by the end of the bed towards which the plates 20 are displaced (arrow F) so that the displacement of the concrete elements and of their moulds, resulting from the relaxing of the reinforcements, is effected in direction opposite that of arrow F, in order to increase the effect of lift of the moulded elements.

The tractive force on the rods 23 may be furnished by jacks. By way of indication, for railway sleepers, the ramps having an inclination of between 4 and 7%, the stroke of the jacks may be of the order of a few decimeters, so that the lift is of the order of a centimeter.

To avoid all the moulded elements being detached simultaneously, which might necessitate jacks of excessive power, the values of the distances d (FIG. 3) may be adjusted for the same cross-piece 17 (or a plurality of crosspieces 17) so as to obtain successive detachment effects.

For example, with the aid of appropriate shims, the pins $\mathbf{14}_3$ and $\mathbf{14}_4$ (FIG. 2) may be adjusted for a first simultaneous detachment, then, with a slightly thicker shim, the distance d may be adjusted to a slightly greater value for pins $\mathbf{14}_2$ and $\mathbf{14}_5$ then, with an even thicker shim, the pins $\mathbf{14}_1$ and $\mathbf{14}_6$ may be adjusted.

To the same ends, it is also possible permanently to fix on the upper face of the crosspieces 17, beneath the heads of pins, plates of increasing thickness (or superposed plates) then to align, by adjustment, all the heads of pins on a single strip of uniform thickness corresponding to the minimum distance d inserted between the thickest plates and the heads of pins such as $\mathbf{14}_3$ and $\mathbf{14}_4$.

In order to limit the amplitude of the force F, it is also possible not to lift the same longitudinal row of elements simultaneously, on condition that there is a very progressive variation of vertical displacement.

For a row of elements having the same distance d, this will be automatic by taking high strength traction rods 23, of relatively small constant section. Due to the elongation of these rods, it will be the elements located nearest the traction jacks which will be detached and lifted first, then the second, and so on. The ramps 20 and the pistons 12 must have a sufficient stroke to absorb the additional horizontal expansion due to the elongation of the rods 23.

The invention is applicable to elongated elements of prestressed concrete employing adherent reinforcements which must comprise, on their moulded faces, hollows or portions in relief of reduced height but of considerable draft; these elements may be railway sleepers, poles, door frame elements, pylons for transporting electrical energy.

What is claimed is:

1. An apparatus for moulding at least a row of prestressed concrete elements and detaching them from their respective moulds comprising, on an elongated horizontal and plane area, at one end, thereof a stretching device and, at the other end, a releasing device for prestressing tendons; a set of parallel bare tendons connected to both said devices; at least a row of aligned, upwardly open moulds resting on said area and longitudinally displaceable thereon, said moulds being traversed by said set of tendons, each mould further comprising at least one vertically moveable bottom portion; a vertically displaceable push member associated with each of said moulds for lifting the corresponding bottom portion; cam means carried by said area for actuating said push members and actuating means for simultaneously operating said cam means.

2. An apparatus according to claim 1 wherein said cam means are ramps coupled in a file and longitudinally sliding on said area further comprising tractive means for displacing said file of ramps.

3. An apparatus according to claim 1 wherein a number of elementary moulds are grouped side by side in a composite mould, the mobile bottom portions of said elementary moulds being transversely aligned, further comprising a transverse member each end of which cooperates with one cam means, the said transverse member being adapted for vertical displacement, for lifting the aligned bottom portions.

4. An apparatus according to claim 3 wherein each said bottom portion centrally comprises a downwardly directed push-piston engaged in a guide-cylinder fast with said composite mould, each said push-piston further having an axial adjusting bolt the head of which cooperates with said transverse member.

5. An apparatus according to claim 3 wherein each elementary mould comprises one mobile bottom portion at each end thereof both aligned portions being associated with a transverse member, said composite mould being elastically supported by said area and further comprising longitudinal girders forming with both said transverse members a frame and elastomer connections between said frame and said composite mould in longitudinal direction.

6. An apparatus according to claim 1 wherein said mould comprises longitudinal, horizontally elongated slots engaging transverse pins fast with said area.

7. An apparatus according to claim 2 wherein said ramps are coupled in file by rods of adjustable length and capable of elastic extension.

8. An apparatus according to claim 2 wherein the slope of said ramps is directed towards the area end provided with the tendon releasing device and the tractive means of the ramp file is located at the same area end.

* * * * *